US008287338B2

(12) United States Patent
Kim

(10) Patent No.: US 8,287,338 B2
(45) Date of Patent: Oct. 16, 2012

(54) GAME APPARATUS FOR LEARNING

(76) Inventor: Young jo Kim, Daegu (KR)

( * ) Notice: Subject to any disclaimer, the term of this patent is extended or adjusted under 35 U.S.C. 154(b) by 426 days.

(21) Appl. No.: 12/376,966

(22) PCT Filed: Jul. 19, 2007

(86) PCT No.: PCT/KR2007/003497

§ 371 (c)(1),
(2), (4) Date: Jun. 1, 2010

(87) PCT Pub. No.: WO2008/018697

PCT Pub. Date: Feb. 14, 2008

(65) Prior Publication Data

US 2010/0279752 A1 Nov. 4, 2010

(30) Foreign Application Priority Data

Aug. 11, 2006 (KR) ..... 10-2006-0075992
Jul. 18, 2007 (KR) ..... 10-2007-0071907

(51) Int. Cl.
*G06F 17/00* (2006.01)

(52) U.S. Cl. ..... 463/1

(58) Field of Classification Search ..... 463/1, 5, 463/7, 9

See application file for complete search history.

(56) References Cited

U.S. PATENT DOCUMENTS

| | | | | |
|---|---|---|---|---|
| 4,197,661 | A * | 4/1980 | Cook et al. | 434/170 |
| 4,736,665 | A * | 4/1988 | Sorribes Arambul | 84/471 R |
| 5,836,583 | A | 11/1998 | Towers | |
| 2009/0001843 | A1 * | 1/2009 | Enomoto et al. | 310/257 |

FOREIGN PATENT DOCUMENTS

| | | |
|---|---|---|
| JP | 04-307078 | 10/1992 |
| KR | 10-2005-0027135 | 3/2005 |

* cited by examiner

*Primary Examiner* — Ronald Laneau
(74) *Attorney, Agent, or Firm* — Christopher Paul Mitchell

(57) ABSTRACT

Disclosed is a game apparatus for learning, in which a rotary plate located between a base plane of a base part and an upper plate of a housing main body is axially connected to a driving body installed in the base part such that the rotary plate is rotatable, a plurality of insertion grooves, into which learning assembly blocks are inserted, are respectively formed in the rotary plate and the upper plate in a circumferential shape, and driving sensing elements connected to the driving body are formed on the base plane. The upper plate is provided with a board unit including a push switch key matrix part, on which a plurality of push buttons is arranged in a matrix structure, and a monitoring matrix part, on which a plurality of LED dots is arranged in a matrix structure.

21 Claims, 16 Drawing Sheets

[Fig. 1]
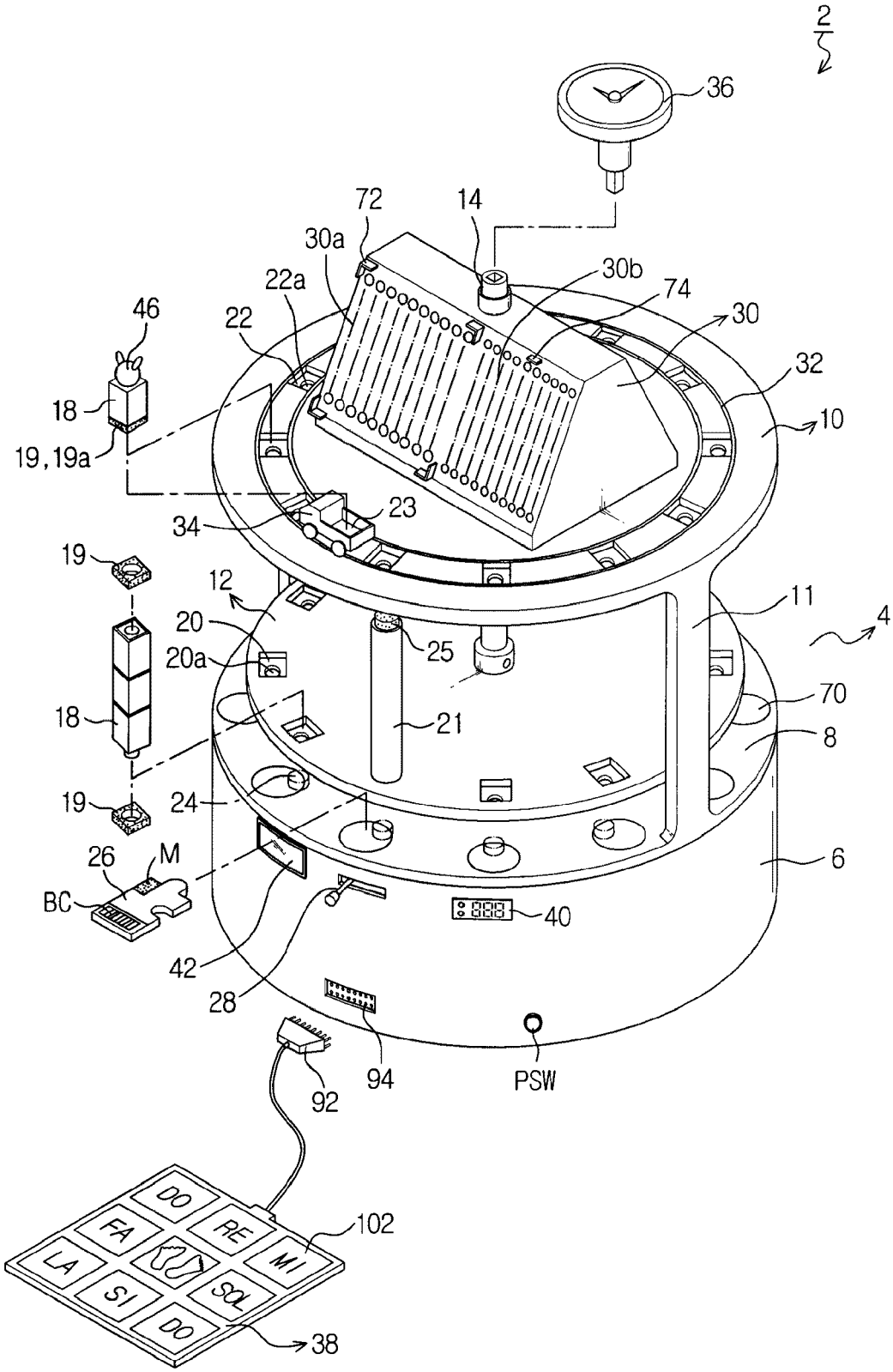

[Fig. 2]
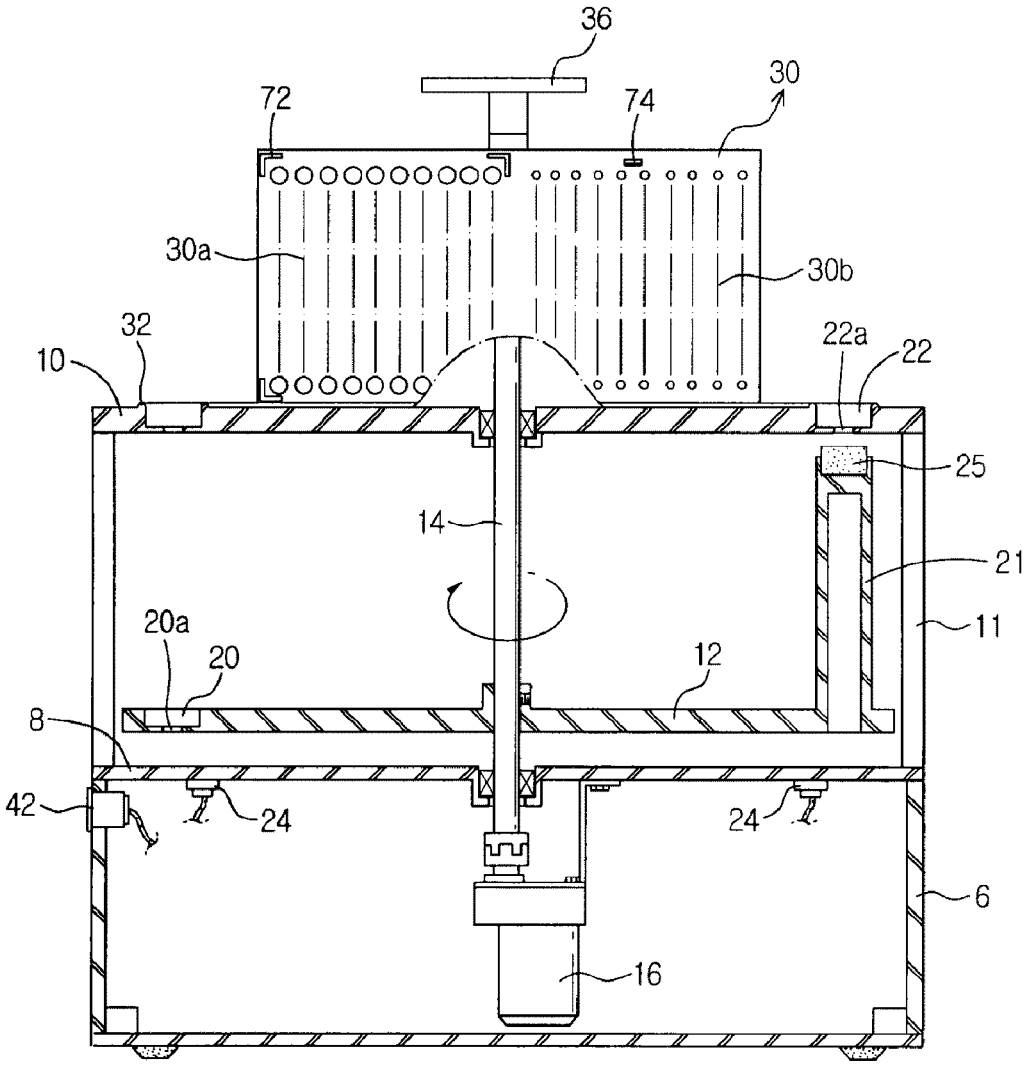

[Fig. 3]
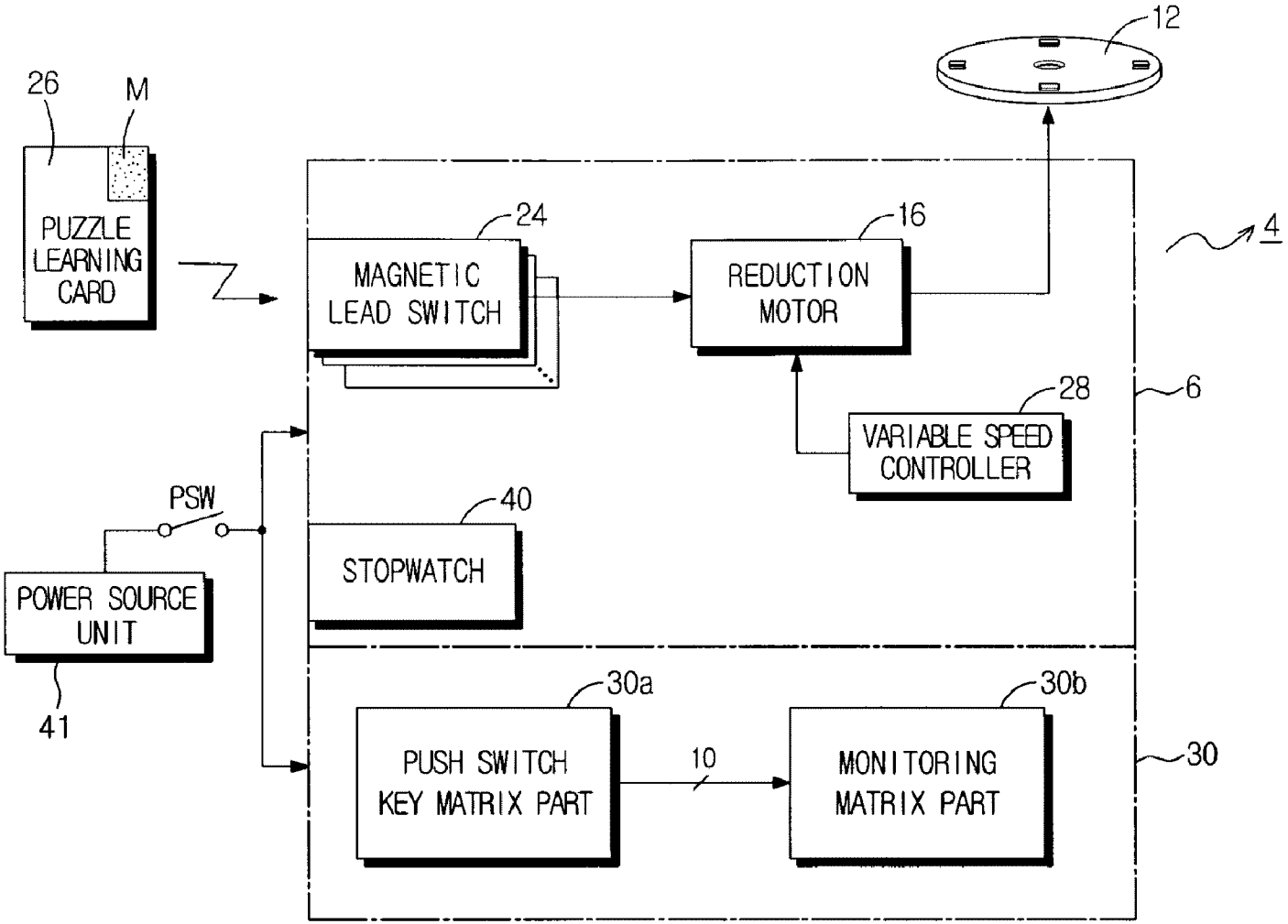

[Fig. 4]
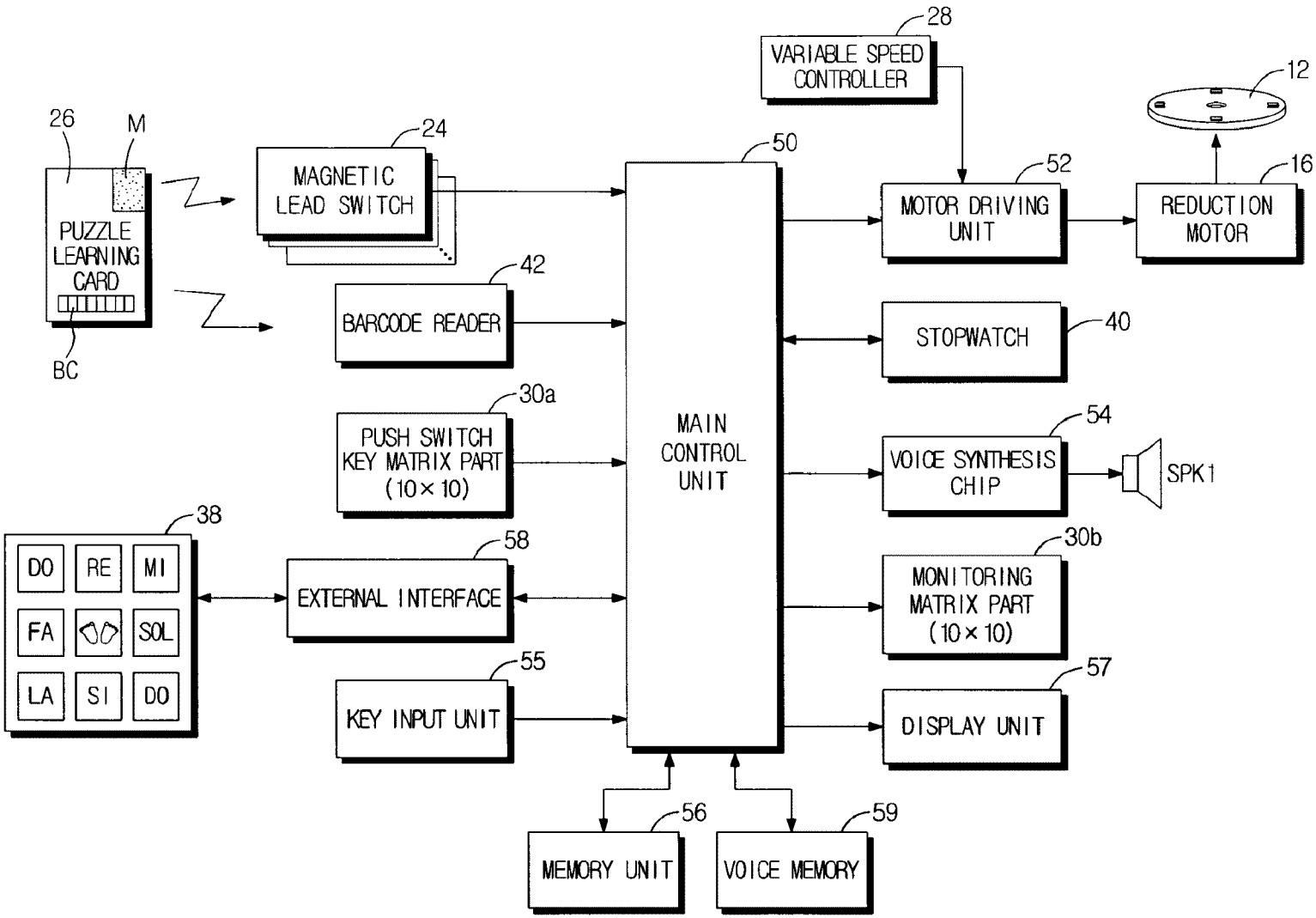

[Fig. 5]
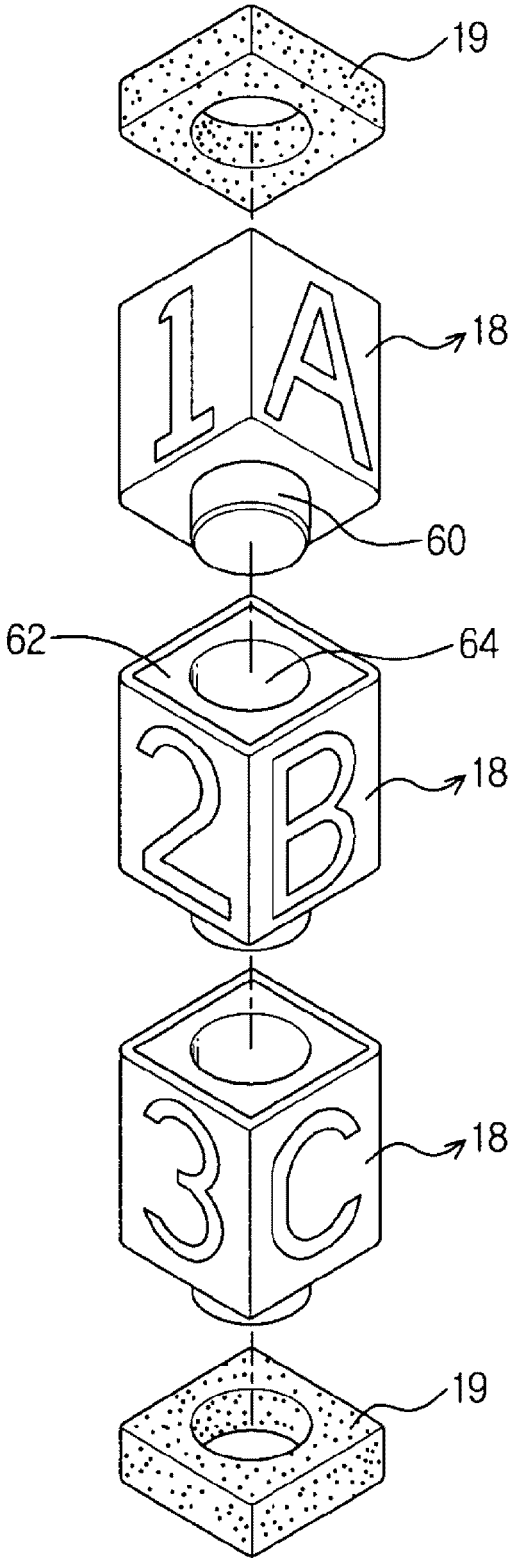

[Fig. 6]
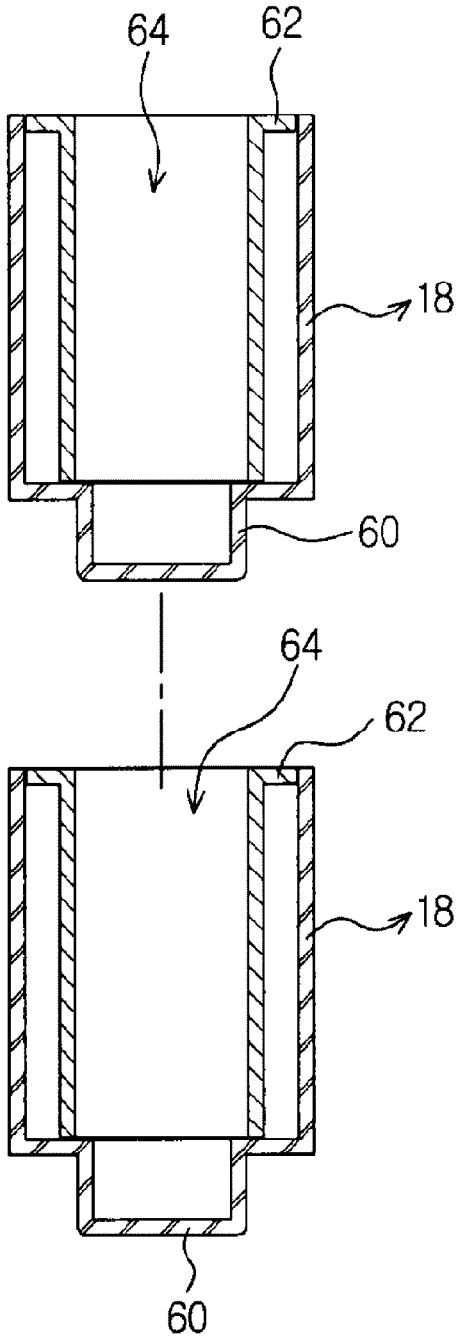

[Fig. 7]
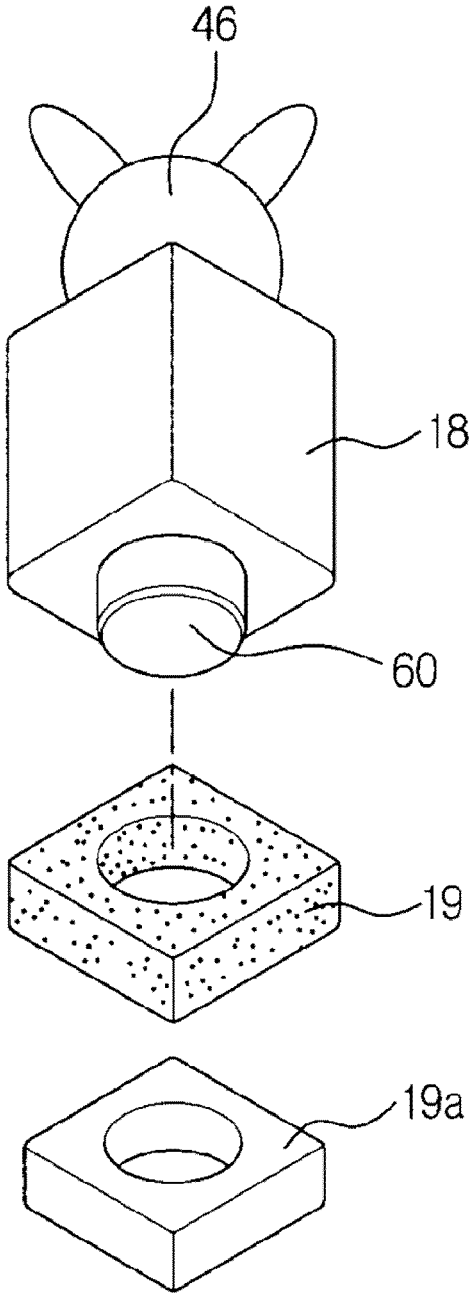

[Fig. 8]
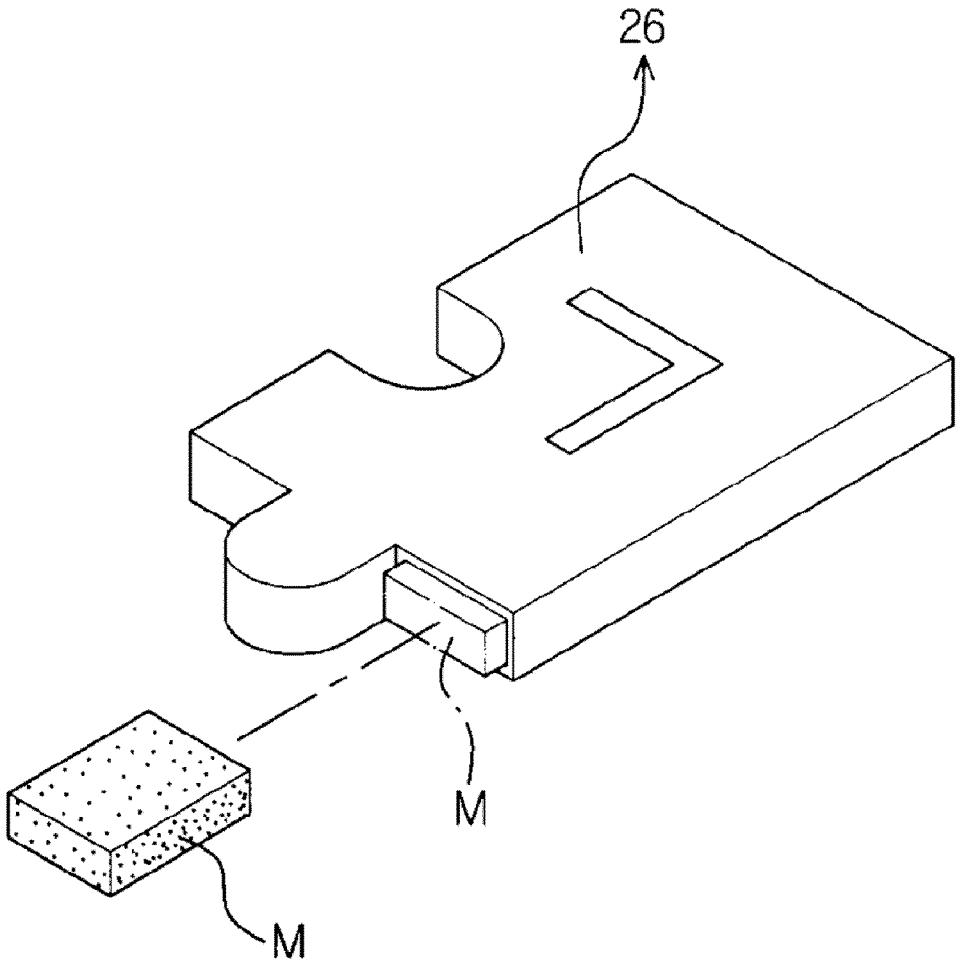

[Fig. 9]
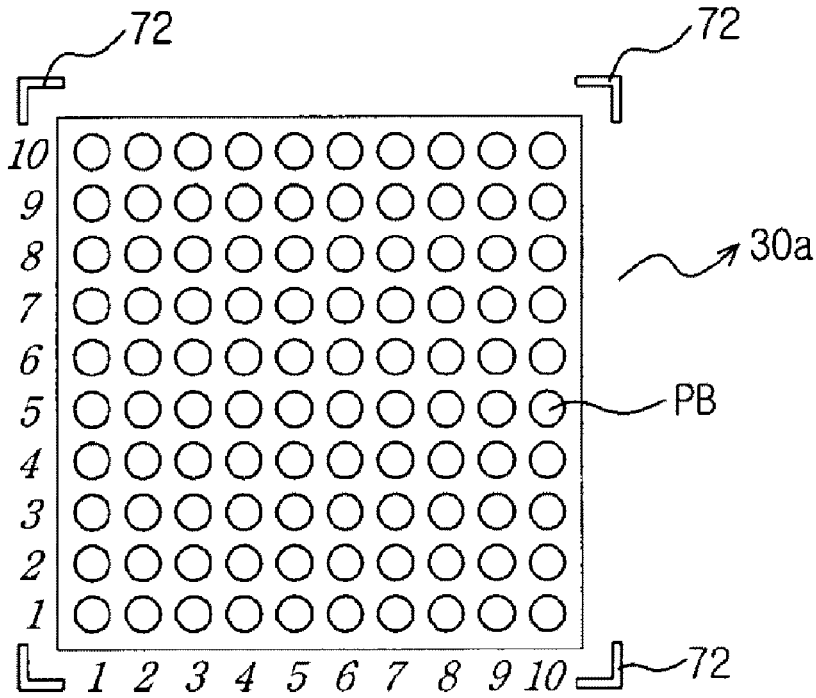
[Fig. 10]
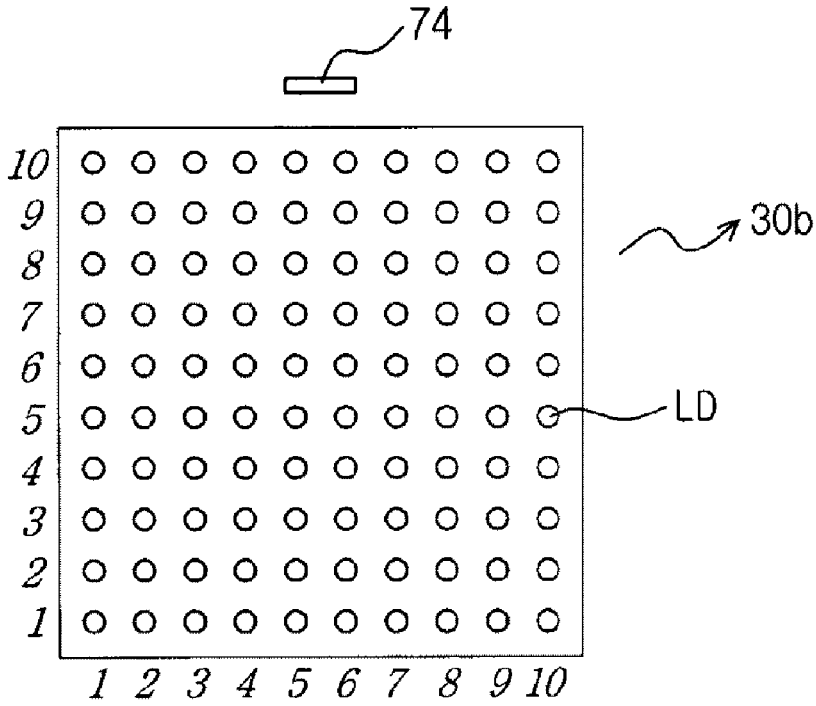

[Fig. 11]
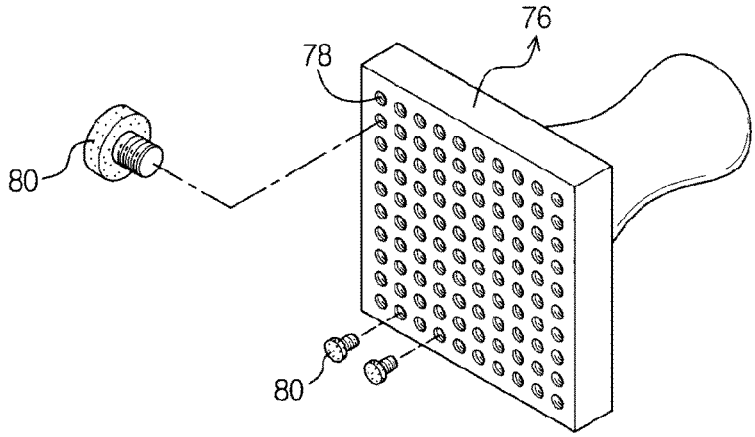
[Fig. 12]
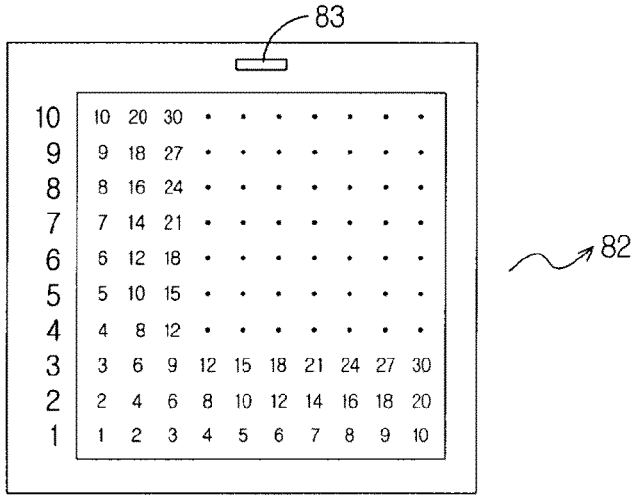
[Fig. 13]
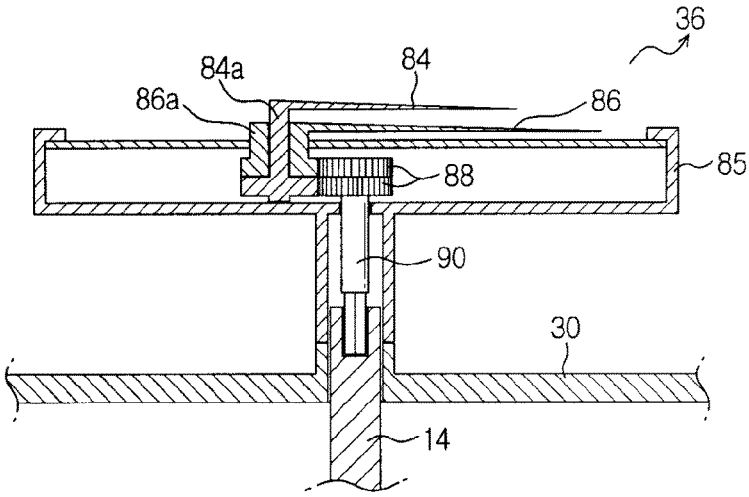

[Fig. 14]
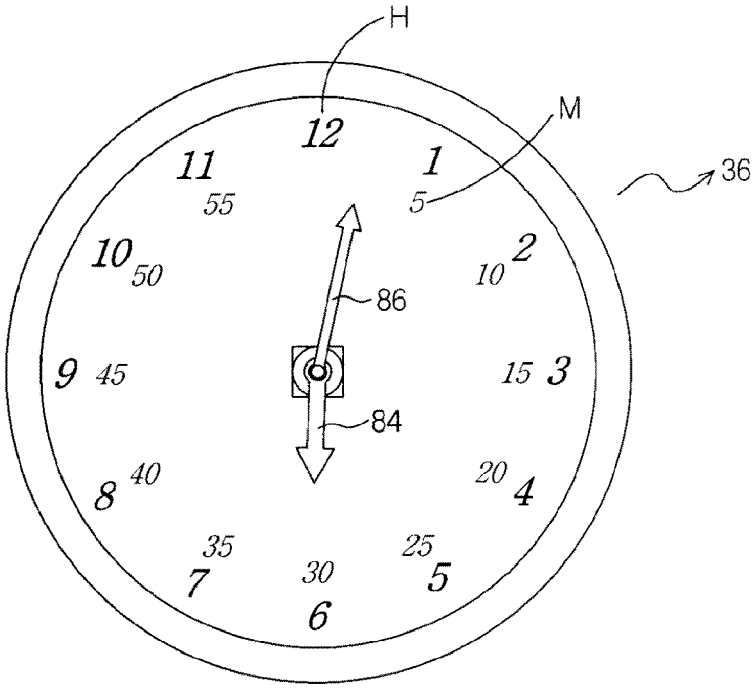
[Fig. 15]
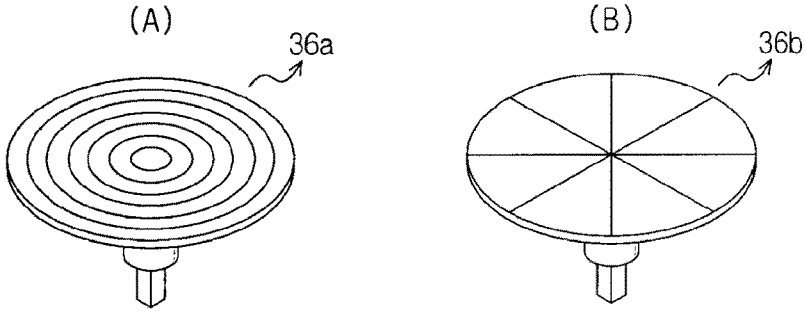
[Fig. 16]
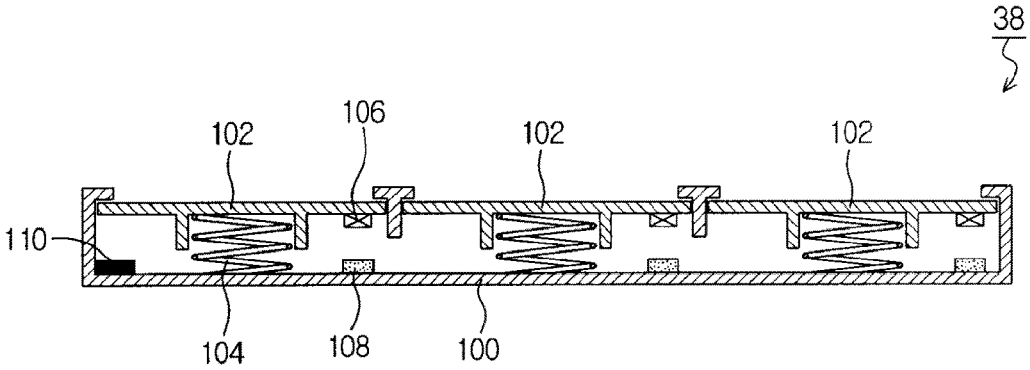

[Fig. 17]
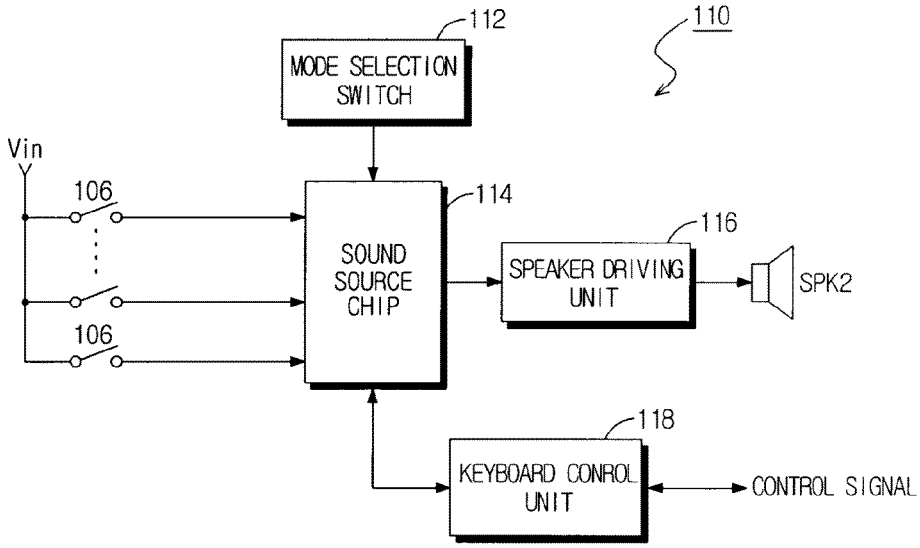
[Fig. 18]
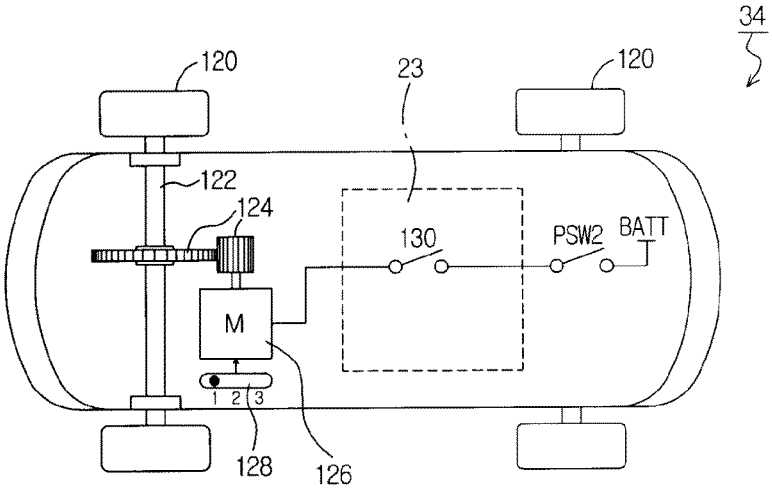
[Fig. 19]
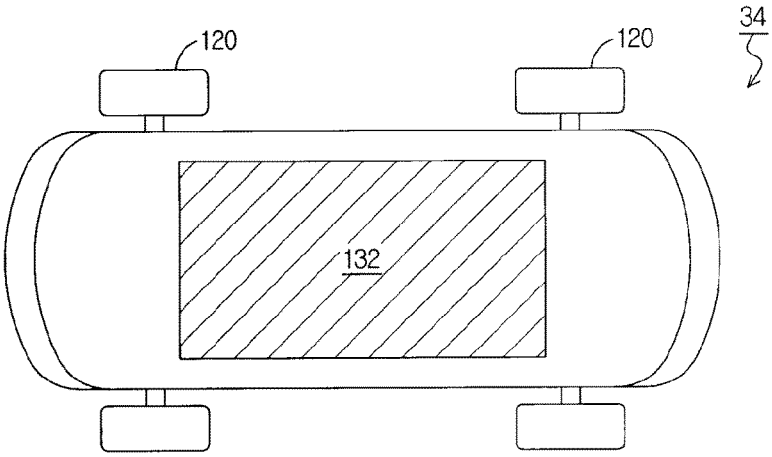

[Fig. 20]
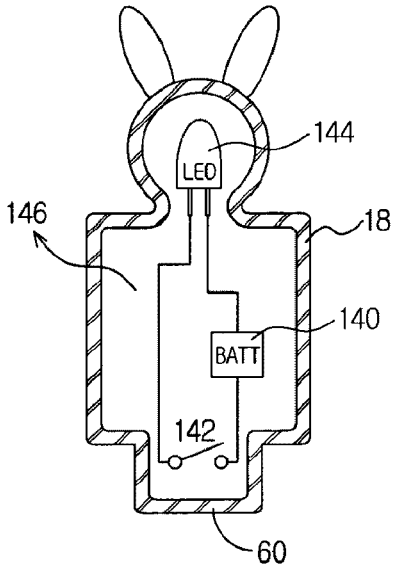
[Fig. 21]
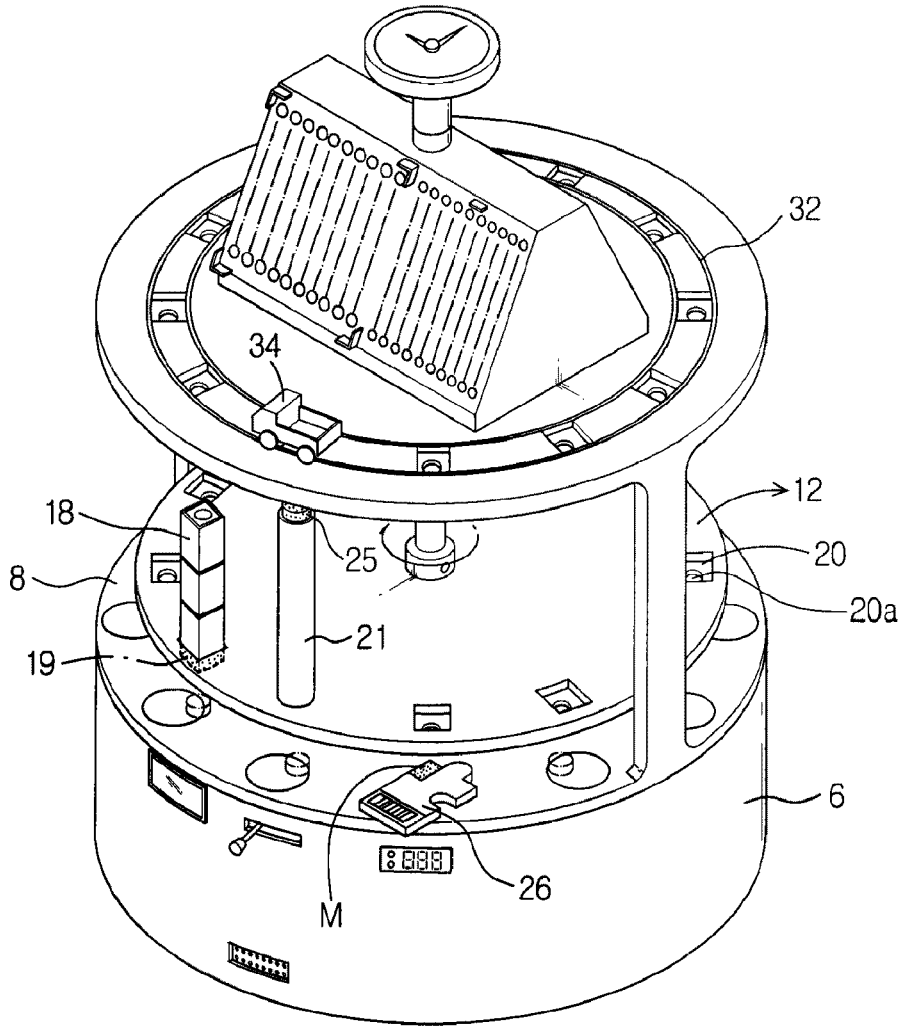

[Fig. 22]
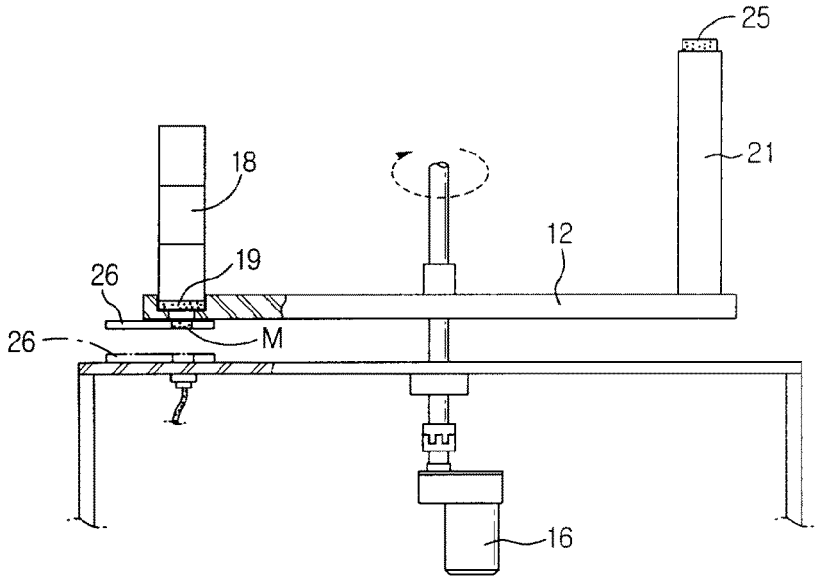
[Fig. 23]
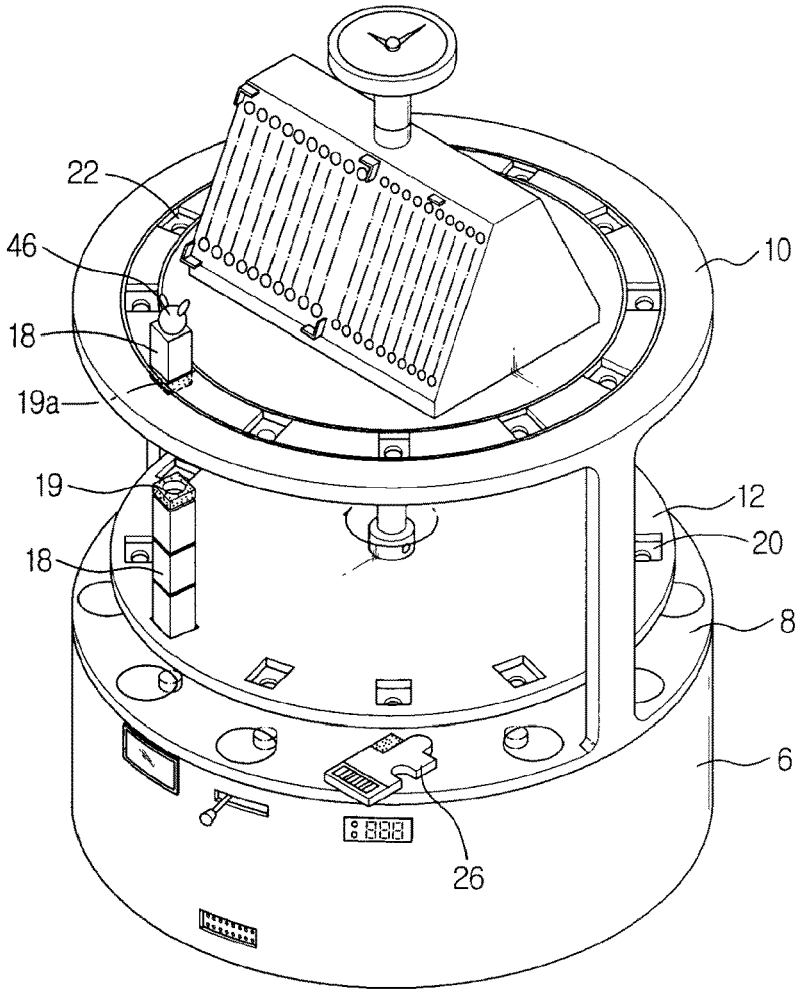

[Fig. 24]
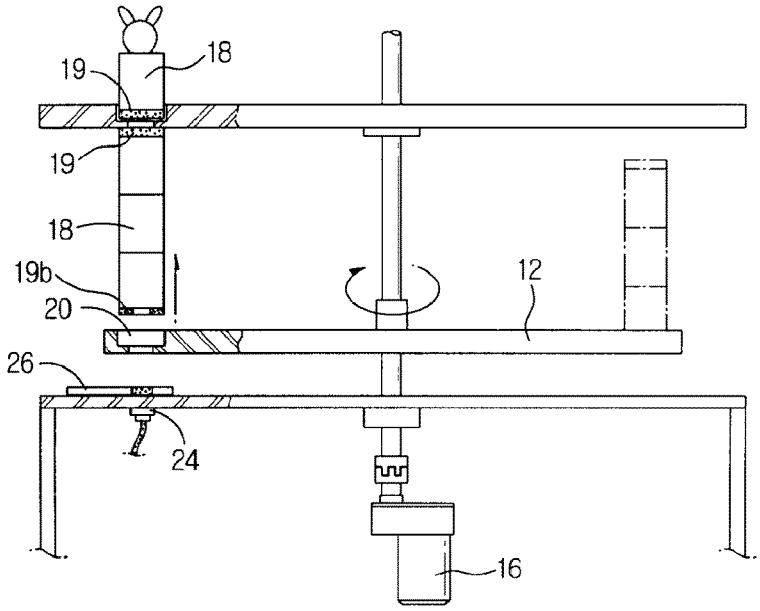
[Fig. 25]
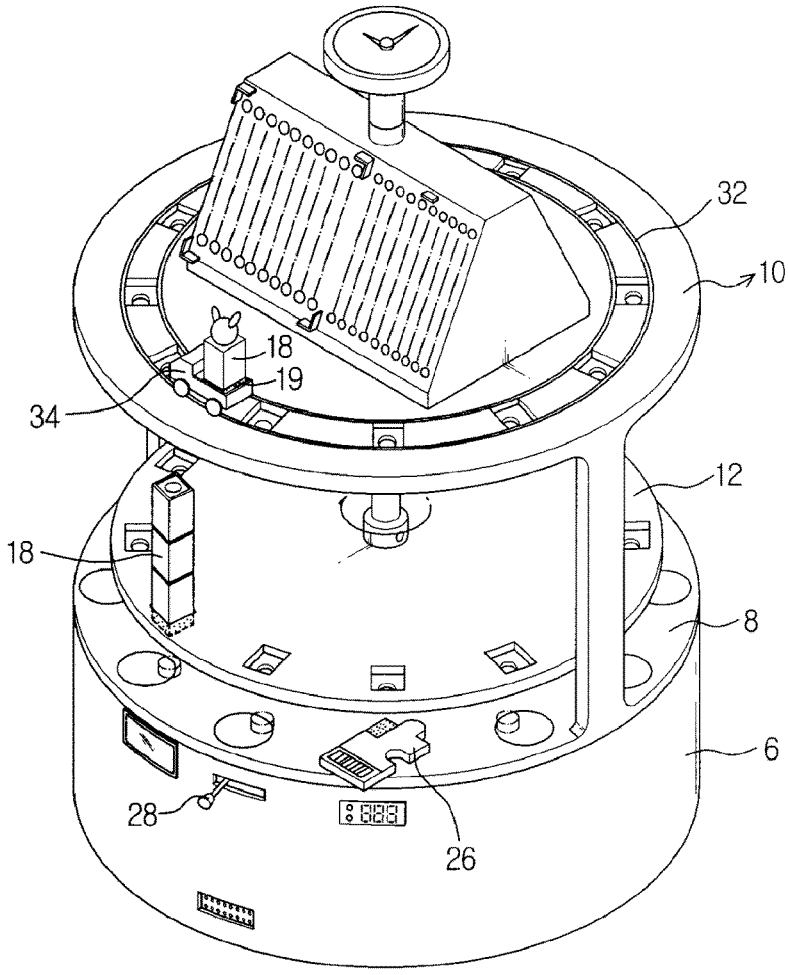

[Fig. 26]
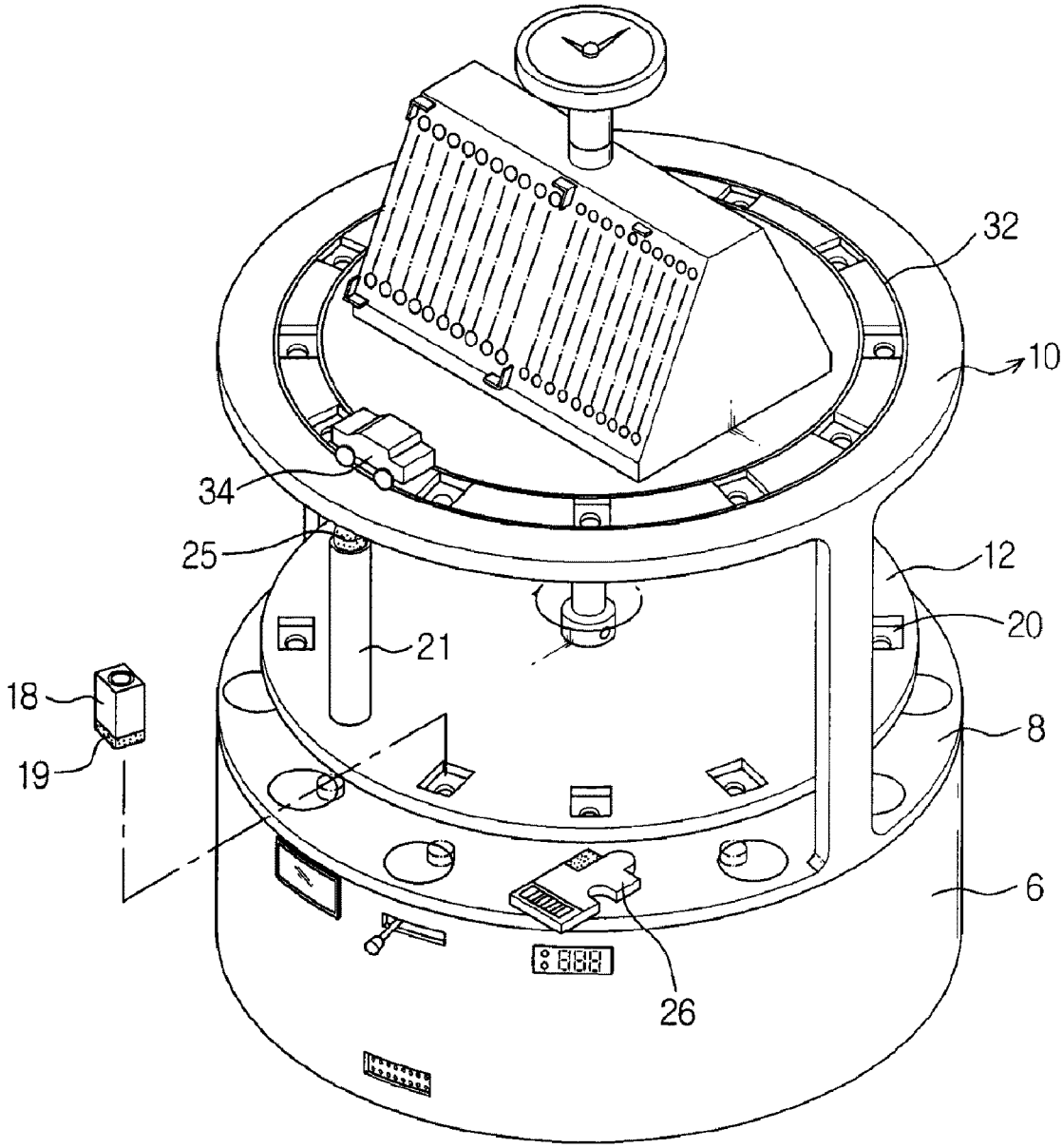

GAME APPARATUS FOR LEARNING

RELATED APPLICATIONS

This application is a 371 application of International Application No. PCT/KR2007/003497, filed Jul. 19, 2007, which in turn claims priority from Korean Patent Application Nos. 10-2006-0075992, filed Aug. 11, 2006, and 10-2007-0071907, filed Jul. 18, 2007, all of which are incorporated herein by reference.

TECHNICAL FIELD

The present invention relates to a playing and learning tool, and more particularly to a game apparatus for learning, which allows users in various age groups from children to old people to positively and pleasantly enjoy multi-functional creativity learning or brain training.

BACKGROUND ART

Recently, creativity education for children is one of methods for growing children into globally talented persons. According to results of researches by experts, one of teaching methods for maximizing the development of creativity is exciting of imagination through play. That is, it is possible to grow a creative problem solving power through play attracting child's interest and attention rather than rote memorization or mastering of skill.

Playing and learning tools or toys, which are on the market now, have extremely simple constitution and function and a low level, and thus are mostly used in simple play, but have a low learning effect, particularly for growing creativity.

The average span of human life at all countries of the world is on an increasing trend due to the economic growth and the medical development. Thus, infirmities of old age, such as senile dementia, are on an increasing trend, and countermeasures for curing or preventing the infirmities of old age must be taken.

Accordingly, the development of a game apparatus for learning, which has an excellent creativity learning effect in case of children and prevents infirmities of old age, such as senile dementia, in case of old people, has been required. Such a game apparatus for learning may attain customer's popularity.

DISCLOSURE OF INVENTION

Technical Problem

Therefore, the present invention has been made in view of the above problems, and it is an object of the present invention to provide a game apparatus for learning, which allows users in various age groups from children to old people to positively and pleasantly enjoy multi-functional creativity learning and brain training.

It is another object of the present invention to provide a game apparatus for learning, which allows children to play a creativity learning game, old people to undergo brain training and hand training for the prevention of dementia and the rehabilitation, and users in various age groups to take aerobic exercise using feet.

It is another object of the present invention to provide a game apparatus for learning, which allows users to design and assemble articles by themselves and to play various games as well as to master concept learning, iterative learning, and confirmation learning using teaching tools.

It is yet another object of the present invention to provide a game apparatus for learning, which allows children or old people to master various educations, such as economy education, letter learning, shape learning, figure learning, language education, such as Chinese characters or Alphabet, logic operation, and the four rules of arithmetic, such as addition, subtraction, multiplication and division.

Technical Solution

In accordance with an aspect of the present invention, the above and other objects can be accomplished by the provision of a game apparatus for learning, in which a rotary plate located between a base plane of a base part and an upper plate of a housing main body is axially connected to a driving body installed in the base part such that the rotary plate is rotatable, a plurality of insertion grooves, into which learning assembly blocks are inserted, are respectively formed in the rotary plate and the upper plate in a circumferential shape, and driving sensing elements connected to the driving body are formed on the base plane.

The upper plate may be provided with a board unit including a push switch key matrix part, on which a plurality of push buttons is arranged in a matrix structure, and a monitoring matrix part, on which a plurality of LED dots is arranged in a matrix structure, such that the push buttons of the switch key matrix part and the LED dots of the monitoring matrix part are matched with each other one to one and are electrically connected to each other.

In accordance with another aspect of the present invention, there is provided a game apparatus for learning, in which a rotary plate located between a base plane of a base part and an upper plate of a housing main body is axially connected to a driving body installed in the base part such that the rotary plate is rotatable, a plurality of insertion grooves, into which learning assembly blocks are inserted, are respectively formed in the rotary plate and the upper plate in a circumferential shape, and driving sensing elements connected to the driving body are formed on the base plane, wherein the upper plate is provided with a board unit including a push switch key matrix part, on which a plurality of push buttons is arranged in a matrix structure, and a monitoring matrix part, on which a plurality of LED dots is arranged in a matrix structure; and the driving sensing elements, the driving body, the push switch key matrix part, and the monitoring matrix part are connected to a controller, which is digitally controllable.

Advantageous Effects

The game apparatus for learning of the present invention allows users in various age groups from children to old people to positively and pleasantly enjoy multi-functional creativity learning and brain training, to design and assemble articles by the themselves and to play various games as well as to master concept learning, iterative learning, and confirmation learning using teaching tools, and to master various educations, such as economy education, letter learning, shape learning, figure learning, language education, such as Chinese characters or Alphabet, logic operation, and the four rules of arithmetic, such as addition, subtraction, multiplication and division.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view of a game apparatus for learning in accordance with an embodiment of the present invention;

FIG. 2 is a longitudinal sectional view of the game apparatus for learning of FIG. 1;

FIG. 3 is a schematic circuit block diagram of the game apparatus for learning of the present invention, which is embodied in an analog type;

FIG. 4 is a schematic circuit block diagram of the game apparatus for learning of the present invention, which is embodied in a digital type;

FIGS. 5 and 6 are perspective and sectional views illustrating learning assembly blocks in an assembled state;

FIG. 7 is a concrete perspective view of a learning assembly block, which is inserted into an insertion groove formed in an upper plate or a toy car;

FIG. 8 is a concrete perspective view of a puzzle learning card;

FIG. 9 is a front view of a push switch key matrix part of a board unit;

FIG. 10 is a front view of a monitoring matrix part of the board unit;

FIG. 11 is a perspective view of a learning stamp plate;

FIG. 12 is a schematic view of a transparent multiplication sheet;

FIGS. 13 and 14 are sectional and plan views of a clock learning tool;

FIGS. 15A and 15B illustrate examples of various learning tools, such as a dart plate and a diagram plate;

FIG. 16 is a sectional view of a melody keyboard;

FIG. 17 is a circuit diagram of an electric circuit unit of the melody keyboard;

FIG. 18 is a schematic view of an electric car, which is driven by itself, among toy cars;

FIG. 19 a schematic view of a driven car, which is driven by external force, among toy cars;

FIG. 20 is a sectional view of a learning assembly block having a head part; and FIGS. 21 to 26 are views for illustrating various examples of learning games.

BEST MODE FOR CARRYING OUT THE INVENTION

Now, a preferred embodiment of the present invention will be described in detail with reference to the annexed drawings.

FIG. 1 is a perspective view of a game apparatus for learning in accordance with an embodiment of the present invention, and FIG. 2 is a longitudinal sectional view of the game apparatus for learning of FIG. 1.

A game apparatus 2 for learning in accordance with the present invention includes a housing main body 4 for allowing a user to play a game for learning. The game apparatus 2 for learning allows the user to train his/her brain or hands selectively using various subsidiary component units for games, for example, a toy car 34, learning assembly blocks 18, puzzle learning cards 26, magnet pieces 19, a melody keyboard 38, a learning stamp plate 76 (in FIG. 11), a clock learning tool 36, a transparent multiplication sheet 82 (in FIG. 12), etc., so as to play various games for learning creativity or to prevent dementia.

The game apparatus 2 for learning of the present invention may be embodied in an analog type provided with an analog circuit, or a digital type provided with a dig-italizing control chip. In FIG. 1, components of both the analog type and the digital type are described.

FIG. 3 is a schematic circuit block diagram of the game apparatus 2 for learning of the present invention, which is embodied in an analog type, and FIG. 4 is a schematic circuit Hock diagram of the game apparatus 2 for learning of the present invention, which is embodied in a digital type. When the game apparatus 2 for learning is embodied in the analog type, the game apparatus 2 for learning has a low price, and when the game apparatus 2 for learning is embodied in the digital type, the game apparatus 2 has various functions. In addition to the analog type of FIG. 3 and the digital type of FIG. 4, the game apparatus 2 for learning of the present invention may be embodied in a hybrid type, in which the analog type and the digital type are combined. The operation of respective circuits of the game apparatuses 2 for learning of FIGS. 3 and 4 will be described after the description of the mechanical components.

First, with reference to FIGS. 1 and 2, the housing main body 4 includes a cylindrical base part 6 provided with a base plane 8, and a circular upper plate 10 formed on upper ends of both supporters 11, perpendicularly extended from the base part 6, integrally with the base part 6. A rotary plate 12 is rotatably and axially installed between the base plane 8 and the upper plate 10 such that the rotary plate 12 is close to the base plane 8. A shaft 14 of the rotary plate 13 is connected to a reduction motor 16 installed in the base part 6. The reduction motor 16 is a driving body for rotating the rotary plate 12, and includes a driving motor and a reducer. The reduction motor 16 receives power supplied from the outside, and controls the rotating speed of the rotary plate 12 based on speed variable control by a user through an external variable speed controller 16.

A plurality of insertion grooves 20 and 22, into which the learning assembly blocks 18 can be inserted, are respectively formed in the upper plate 10 and the rotary plate 12 at regular intervals in a circumferential shape. Preferably, through holes 20*a* and 22*a* are respectively formed through the bottoms of the insertion grooves 20 and 22 so that magnetic force is more easily applied to the insertion grooves 20 and 22. The separation space between the rotary plate 12 and the upper plate 10 has a height enough to sufficiently stack a plurality of the learning assembly blocks 18, i.e., three learning blocks 18, therein.

An extension rod 21 is extended from the upper surface of the rotary plate 12 close to the lower surface of the upper plate 10. Here, the extension rod 21 coincides with a guide track 32 of the upper plate 10, and a magnetic core 25 is connected to the upper end of the extension rod 21 such that the magnetic core 25 can be exposed from the upper end of the extension rod 21. When the extension rod 21 moves, the toy car 34 runs along the guide track 32 of the upper plate 10.

Although the extension rod 21 provided with the upper end, to which the magnetic core 25 is connected, is described, those skilled in the art will appreciate that only a rod, into which a magnet piece 19 is inserted, is provided and a magnetic piece may be connected to the rod so that the magnet piece 19 is attached to the rod by magnetic force.

Each of the learning assembly blocks 18 inserted into the insertion grooves 20 and 22 of the rotary plate 12 and the upper plate 10 has a structure such that each of the learning assembly blocks 18 is assembled with another one of the learning assembly blocks 18 by insertion or the magnet piece 19, a metal piece 19*a*, or a plastic piece 19*b* (FIG. 24) provided with a through hole may be selectively inserted into or attached to each of the learning assembly blocks 18, as shown in FIG. 5. That is, as shown in FIG. 6, each of the learning assembly blocks 18 is provided with an insertion protrusion 60 formed on the lower portion of a main body, and a magnetic piece 62 made of iron and having an insertion hole 64 is connected to the upper portion of the main body so that the insertion protrusion 60 is inserted into the magnet piece 19, i.e., a magnetization body, or the magnet piece 19 is attached to the upper surface of the magnetic piece 62. The insertion protrusion 60 of another one of the learning assembly blocks 18 is inserted into the insertion hole 64.

Each of the learning assembly blocks 18 has a shape of a square pillar, as shown in FIG. 5, or other shapes (a cylinder, a triangular prism, a pentagonal prism, etc.). Further, letters, such as Hangul, Chinese characters, or Alphabet, numbers, figures, and/or shapes (paper money, animals, fruits, vegetables, avatars, animation characters, etc.) are formed on the surface of each of the learning assembly blocks 18, and thus a user can complete a word of the corresponding language or serial numbers by combining the learning assembly blocks 18. In the learning assembly block 18 inserted into the insertion groove 22 of the upper plate 10 or loaded on a loading part 23 of the toy car 34, it is preferable that the insertion protrusion 60 is formed on the lower portion of the main body of the learning assembly block 18 and a head part 46 having a shape of an animal or a character is formed on the upper portion of the main body of the learning assembly block 18, as shown in FIGS. 1 and 7.

As shown in FIG. 20, the learning assembly block 18 provided with the head part 46 inserted into the corresponding one of the insertion grooves 22 of the upper plate 10 includes an electric circuit unit 146, in which a magnetic lead switch 142 and an LED 144 are connected to a small battery 140 in series, formed in the main body. When the magnetic lead switch 142 is turned on by the magnet piece, the head part 46 of the learning assembly block 18 emits light by means of the LED 144, thus being lighted up. Further, the insertion protrusion 60 the learning assembly block 18 provided with the head part 46 is inserted into the magnet piece 19 or the metal piece 19*a*.

A plurality of magnetic lead switches 24, i.e., a type of driving sensing elements, is disposed on the lower surface of the base plane 8 of the base part 6 at regular intervals in a circumferential shape. The magnetic lead switches 24 are electrically connected to the reduction motor 16 directly or indirectly. The magnetic lead switches 24 are one type of the driving sensing elements. Here, other various types of the driving sensing elements, such as hall sensors, optical sensors, image sensors, and proximity sensors, may be used. The magnetic lead switches 24 used in the embodiment of the present invention are driving sensing elements, which are, easily applied to both an analog type and a digital type.

When the puzzle learning card 26, including a piece (M) made of a magnet to be sensed, is mounted at a position of the magnetic lead switch 24 on the base plane 8 of the base part 6, the magnetic lead switch 24 senses the piece (M) of the puzzle learning card 26 and is switched on, and thus drives the reduction motor 16. Accordingly, the rotary plate 12 connected to the reduction motor 16 by the shaft 14 is rotated.

As shown in FIG. 8, letters, such as Hangul, Chinese characters, or Alphabet, numbers, figures, and/or shapes (paper money, animals, fruits, vegetables, avatars, animation characters, etc.) are formed on the surface of the puzzle learning card 26. Here, a plurality of puzzle learning card 26 is provided so as to allow a user to play a puzzle. The puzzle learning card 26 has a structure such that the piece (M) to be sensed, made of a genuine magnet or a forged magnet, is inserted into the puzzle learning card 26. Further, in case of need of a manufacturer, an identifier bar code (BC), such as a bar code for individual identification, is selectively formed in the puzzle learning card 26.

Guide signs 70 may be formed at positions coinciding with the positions of the magnetic lead switches 24 on the upper surface of the base plane 8 of the base part 6, on which the puzzle learning card 26 is mounted. The guide signs 70 are signs for informing the user of position data, for example, a station name, a number, an alphabet letter, a number of an analog clock, etc.

A board unit 30 having inclined front and rear plates is installed at the center of the upper plate 10 of the housing main body 4, and the guide track 32, along which the toy car 34 runs, is formed on the edge of the upper plate 10 in a circumferential shape. The toy car 34 has a children's favorite shape of one selected from the group consisting of a truck, an automobile, a train, and a mini robot, and has a type of an electric car, which is driven by itself, or a driven car, which is driven by external force.

The board unit 30 includes a push switch key matrix part 30*a* formed at the left of the front surface thereof, and a monitoring matrix part 30*b* formed at the right of the front surface thereof.

FIG. 9 is a front view of the push switch key matrix part 30*a* of the board unit 30, and FIG. 10 is a front view of the monitoring matrix part 30*b* of the board unit 30.

With reference to FIGS. 9 and 10, push buttons (PBs) arranged in a 10×10 matrix structure are formed on the switch key matrix part 30*a* of the board unit 30, and LED dots (LDs) arranged in a 10×10 matrix structure are formed on the monitoring matrix part 30*b* of the board unit 30. The push buttons (PBs) of the switch key matrix part 30*a* and the LED dots (LDs) of the monitoring matrix part 30*b* are matched with each other one to one, and are electrically connected to each other. Numbers of 1 to 10 in rows and ranks along horizontal and vertical axes of coordinates are written on the push switch key matrix part 30*a* and the monitoring matrix part 30*b*, for the convenience of users. For example, when a user presses the push button (PB) at a point in the third row and the third rank on the push switch key matrix part 30*a*, the LED dot (LD) at a point in the third row and the third rank on the monitoring matrix part 30*b* is lighted up.

Guide pieces 72 having an "L" shape are respectively protruded from corners of the push switch key matrix part 30*a*. Thus, the four guide pieces 72 allow a learning stamp plate 76, as shown in FIG. 11, to be correctly guided to the push switch key matrix part 30*a* and press corresponding push buttons (PB).

As shown in FIG. 11, the learning stamp plate 76 is provided with open holes 78 arranged in a 10×10 matrix structure and formed in the lower surface of the main body thereof, and rubber head screws 80 are respectively connected to the open holes 78. In order to express a desired letter on the monitoring matrix part 30*b* by pressing the learning stamp plate 76 onto the push switch key matrix part 30*a*, a shape, which is bilaterally symmetrical with the letter on the monitoring matrix part 30*b*, is formed on the lower surface of the learning stamp plate 76.

For example, in order to express an alphabet letter "K" on the monitoring matrix part 30*b*, a user connects the rubber head screws 80 to the corresponding open holes 78 of the lower surface of the learning stamp plate 76 so as to form a shape, which is bilaterally symmetrical with the alphabet letter "K", and then presses the learning stamp plate 76 onto the push switch key matrix part 30*a*. Thereby, the LED dots (Ws) of the monitoring matrix part 30*b*, corresponding to the push buttons (PBs) pressed by the rubber head screws 80 of the learning stamp plate 79, are lighted up. When the correct shape of the alphabet letter "K" is expressed on the monitoring matrix part 30*b*, it is determined that the user correctly forms the shape bilaterally symmetrical with the alphabet letter "K" on the learning stamp plate 76. In the case that the game apparatus 2 for learning is embodied in a digital type, the game apparatus 2 for learning is controlled such that a message informing the user of a correct answer is outputted and the toy car 34 runs for congratulation under the control of a main control unit 50 (FIG. 5) when a corresponding shape is correctly formed on the learning stamp plate 76.

Since a user designs a shape formed on the learning stamp plate 76 by himself/herself so as to be bilaterally symmetrically with a letter to be expressed, the learning stamp plate 76 has an excellent learning effect.

A hanging piece 74, to which a transparent multiplication sheet 82, as shown in FIG. 12, is fixed, is formed on the upper portion of the monitoring matrix part 30*b* formed at the right of the front surface of the board unit 30. The transparent multiplication sheet 82 is provided with a hanging groove 82 formed in the upper portion thereof, and numbers, which are correct answers of the multiplication tables from 1 to 10, are arranged in a 10×10 matrix structure on the transparent multiplication sheet 82. When a user fixes the transparent multiplication sheet 82 to the monitoring matrix part 30*b* by inserting the hanging piece 74 into the hanging groove 83 of the transparent multiplication sheet 82 and presses a push button, for example, the push button (PB) at a point in the third row and the third rank on the push switch key matrix part 30*a*, the LED dot (LD) at a point in the third row and the third rank on the monitoring matrix part 30*b* is lighted up. A numeral "9" is written on the transparent multiplication sheet 82 at the LED dot (LD) at the point in the third row and the third rank of the monitoring matrix part 30*b*, and thus the user can confirm that the numeral "9" at a light emitting spot is a correct answer. Further, in the case that the game apparatus 2 for learning is embodied in a digital type, the game apparatus 2 for learning is controlled such that after several seconds from the lighting up of the LED dot (LD) at the point in the third row and the third rank on the monitoring matrix part 30*b* has elapsed, nine LED dots (LDs) are simultaneously lighted up, so as to allow the user to learn a numeral concept.

With reference to FIG. 1 again, a white board is installed on the rear surface of the board unit 30, if necessary. Further, in the case that the game apparatus 2 for learning is embodied in a digital type, the rear surface of the board unit 30 is provided with a main control unit 50 (FIG. 4) and a key input unit 55 and a display unit 57 for user interfaces.

The upper end of the shaft 14 connected to the reduction motor 16 is protruded from the upper surface of the board unit 30, and the clock learning tool 36, as shown in FIGS. 1, 13, and 14, and various learning tools, such as a dart plate and a diagram plate, as shown in FIGS. 15A and 15B, are selectively attached to and detached from the upper end of the shaft 14.

FIGS. 13 and 14 are sectional and plan views of the clock learning tool 36, and FIGS. 15A and 15B illustrate various rotatable plate-type learning tools 36*a* and 36*b*, such as a dart plate and a diagram plate.

With reference to FIGS. 13 and 14, numerals indicating hour (H) and minute (M) are disposed along the circumference of the upper surface of a main body 85 of the clock learning tool 36. Driven shafts 84*a* and 86*a* of a hour hand 84 and a minute hand 86 are connected to a transmission shaft 90 through gears 88, and the transmission shaft 90 is connected to the shaft 14 of the rotary plate 12 installed on the housing main body 4. The gear ratio of the hour hand 84 to the minute hand 86 is 12:1 in the same manner as a general clock such that the hour hand 84 is rotated once while the hour hand 86 is rotated twice.

In FIG. 1, a non-described numeral "38" represents a melody keyboard, a non-described numeral "40" represents a stopwatch, and a non-described numeral "42" represents a barcode reader.

In FIG. 1, the melody keyboard 38 is electrically connected to a connection port 94 of the housing main body 4 through a connector 92. When the connector 92 of the melody keyboard 38 is connected to the connection port 94 of the housing main body 4, an operation voltage supplied from the housing main body 4 is applied to the melody keyboard 38. When the melody keyboard 38 and the housing main body 4 are embodied into a digital type, a keyboard control unit of the melody keyboard 38 and a control unit of the housing main body 4 interfaces a control signal with each other.

FIG. 16 is a sectional view of the melody keyboard 38 of FIG. 1.

With reference to FIGS. 1 and 16, the melody keyboard 38 includes eight musical scale input plates 102 installed on a keyboard main body 100 for inputting scales including do, re, mi, fa, sol, la and si. Each of the musical scale input plates 102 are elastically supported by a spring 104 installed in the keyboard main body 100. Magnetic lead switches 106 are respectively installed on the lower surfaces of the musical scale input plates 102, and magnet pieces 108 are installed on the bottom of the keyboard main body 100 so as to correspond to the magnetic lead switches 106 of the musical scale input plates 102. The magnetic lead switches 106 are connected to an electric circuit unit 110 installed in the melody keyboard 38.

FIG. 17 is a circuit diagram of the electric circuit unit 110 of the melody keyboard The electric circuit unit 110 of the melody keyboard 38 includes a mode selection switch 112 for selecting a melody mode and a musical scale mode, a sound source chip 114 for generating a melody sound and a musical scale sound, a speaker driving unit 116, and a speaker SPK2. In the case that the melody keyboard 38 is embodied into a high specification, the electric circuit unit 110 of the melody keyboard 38 further includes a keyboard control unit 118. The magnetic lead switches 106 are connected to input ports of the sound source chip 114.

When a user selects the melody mode using the mode selection switch 112 provided on the external surface of the melody keyboard 38, the sound source chip 114 activates the melody mode so as to generate melody corresponding to each of the eight musical scale input plates 102, and when the user selects the musical scale mode, the sound source chip 114 activates the musical scale mode so as to generate the musical scale corresponding to each of the eight musical scale input plates 102. The keyboard control unit 118 interfaces the main control unit 50 (FIG. 5) of the housing main body 4, and receives and transmits a control signal.

Hereinafter, the operation of the keyboard control unit 118 will be described.

When a user has normally completed a musical performance using the musical scale input plates 102, the keyboard control unit 118 transmits a control signal corresponding to the normal musical performance to the main control unit 50 of the main body housing 6. When the main control unit 50 receives the control signal corresponding to the normal musical performance, the main control unit 50 controls the reduction motor 16 so as to rotate the rotary plate 12, and causes the toy car 34 on the upper plate 10 to run for congratulation by means of the magnetic core 25 on the upper end of the extension rod 21. Further, the main control unit 50 causes the speaker SPK1 to output a congratulation message.

Next, the operation of the melody keyboard 38 will be described hereinafter.

When a user steps on a musical scale plate 102 under the condition that the melody keyboard 38 is in the musical scale mode, the corresponding musical scale plate 102 descends. Then, the magnetic lead switch 106 attached to the lower surface of the musical scale plate 102 is close to the corresponding magnet piece 108 installed on the bottom of the keyboard main body 100, and the corresponding magnetic lead switch 106 is switched on. Thus, the sound source chip 114 recognizes the switching on of the corresponding magnetic lead switch 106 through the corresponding input port, and generates a sound of the corresponding musical scale to the speaker SPK2 through the speaker driving unit 116.

Further, when the user strikes a musical scale plate 102 with a bellows-type plastic hammer provided with a magnet piece installed therein, the magnet piece in the plastic hammer switches on the magnetic lead switch 106 attached to the lower surface of the corresponding musical scale plate 102. Then, in the same manner as the above method, the sound source chip 114 generates a sound of the corresponding musical scale.

With reference to FIG. 1 again, the toy car 34 runs along the guide track 32 of the upper plate 10 of the housing main body 4. The toy car 34 has a children's favorite shape of one selected from the group consisting of a truck, an automobile, a train, and a mini robot. Further, the top car 34 has a type of an electric car, which is driven by itself, or a driven car, which is driven by external force.

FIG. 18 is a schematic view of an electric car, which is driven by itself, among the toy cars 34, and FIG. 19 a schematic view of a driven car, which is driven by external force, among the toy cars 34.

With reference to FIG. 18, in the toy car 34 having a type of an electric car, any one of shafts 122 of front and rear wheels 120 is connected to a driving motor 126 through gears 124. The driving motor 126 is connected to a battery BATT through a magnetic lead switch 130 and a power switch PSW2. The magnetic lead switch 130 is located under the loading part 23 of the toy car 34, and is switched on when the magnet piece 19 is loaded on the loading part 23 of the toy car 34. A speed selection switch 128 for selecting the speed of the toy car 34 from a one grade to a three grade is connected to the driving motor 126.

With reference to FIG. 19, in the toy ear 34 having a type of a driven car, front and rear wheels 120 and a magnetic plate 132 are fixed to the lower surface of the toy car 34. Thus, the toy car 34 is driven by the magnetic force of the magnetic core 25 connected to the upper end of the extension rod 21 or the magnetic force of the magnet piece 19 attached to the learning assembly block 18 inserted into the rotary plate 12.

Hereinafter, with reference to FIGS. 3 and 4, the constitution of a circuit of the game apparatus 2 for learning in accordance with the embodiment of the present invention will be described.

FIG. 3 is a schematic circuit block diagram of the game apparatus 2 for learning of the present invention, which is embodied in an analog type, and FIG. 4 is a schematic circuit block diagram of the game apparatus 2 for learning of the present invention, which is embodied in a digital type.

As shown in FIG. 3, when the game apparatus 2 for learning of the present invention, which is embodied in an analog type, an electric circuit unit of the housing main body 4 does not include a control chip.

With reference to FIG. 3, in the electric circuit unit of the housing main body 4 of the game apparatus 2 for learning in the analog type, a power source unit 41 is a circuit unit, which generates a DC operation voltage from external power or internal battery power and supplies the operation voltage to respective components. That is, the power source unit 41 supplies the operation voltage to the respectively magnetic lead switches 24 of the base part 6 through a power switch PSW provided at the outside of the electric circuit unit, and supplies the operation voltage to the stop watch 40 and respective dot switches of the push switch key matrix part 30*a* of the board unit 30.

The magnetic lead switches 24 arranged on the base plane 8 of the base part 6 are switched on by the piece (M) made of a magnet, to be sensed, inserted into the puzzle learning card 26, and thus transmits the operation voltage supplied through the power switch PSW to the reduction motor 16 so as to drive the reduction motor 16. When any key button on the push switch key matrix part 30*a* is pressed, the corresponding push switch is switched on. Thereby, the supplied operation voltage is transmitted to the corresponding LED dot (LD) of the monitoring matrix part 30*b*, and thus the corresponding LED dot (LD) is lighted up.

Then, with reference to FIG. 4, the electric circuit unit of the housing main body 4 of the game apparatus 2 for learning in the digital type includes control chips, such as the main control unit 50 and a voice synthesis chip 54, the barcode reader 42, the key input unit 55, and the display unit 57. The main control unit 50 performs various control operations regarding learning games based on a program stored in a memory unit 56, and generally controls the respective components. The barcode reader 42 reads a barcode formed on the puzzle learning card 26, and outputs the read data to the main control unit 50. The barcode reader 42 is one type of readers for reading identifiers, such as the barcode, and other types of readers may be used.

Here, the constitution of the electric circuit unit in the digital type, including the magnetic lead switches 24, the push switch key matrix part 30*a*, the stopwatch 40, and the monitoring matrix part 30*b*, is substantially the same as that of the electric circuit unit in the analog type of FIG. 3, but these components are operated under the control of the main control unit 50. The main control unit 50 controls the driving of the reduction motor 16 through a motor driving unit 52, and a variable speed controller 28 is connected to the motor driving unit 52. The voice synthesis chip 54 synthesizes various voices and sounds under the control of the main controller 50, and outputs the synthesized voices and sounds to the outside through the speaker SPK1. An external interface 56 interfaces a control signal between the keyboard control unit 118 of the melody keyboard 38 and the main control unit 50. A voice memory 59 stores various voice data including a recorded voice under the control of the main controller 50. The voice data stored in the voice memory 59 are read under the control of the main controller 50, and are outputted through the speaker SPK1.

Further, the electric circuit unit in the digital type includes the key input unit 55 and the display unit 57, which are operated under the control of the main controller 50, and thus provides user interfaces. A user selects various modes, which are set in the main controller 50, using the user interfaces, such as the key input unit 55 and the display unit 57.

Hereinafter, an operation of allowing a learner to learn using the above game apparatus for learning will be described in more detail.

The game apparatus for learning in accordance with the embodiment of the present invention allows learners, such as children and old people, to express numbers, letters, figures, and/or letter shapes, such as Chinese characters or Alphabet, while designing a desired shape and touching an article by themselves. Further, the game apparatus for learning allows the learners to enjoy creativity learning and brain training using the toy car, the learning assembly blocks, the puzzle learning cards, etc. That is, the learners can play various learning games using the game apparatus for learning of the present invention. Preferably, a guide book for guiding various learning methods is further provided to the learners.

First, one example of learning games using the puzzle learning cards 26, the learning assembly blocks 18, and the magnet pieces 19 will be described, as follows.

FIG. 21 illustrates one example of learning games using the puzzle learning cards 26, the learning assembly blocks 18, and the magnet pieces 19.

A guide, such as a teacher or a parent, assemblies the learning assembly blocks 18 such that a designated word, for example a word "ant", is Farmed on the surface of the assembled unit of the learning assembly blocks 18, and simultaneously inserts the magnet piece 19 into the lower portion of the assembled unit of the learning assembly blocks 18. Thereafter, the guide inserts the assembled unit of the learning assembly blocks 18 into any insertion groove 20 of the rotary plate 12. Then, the guide selects a puzzle learning card 26 having an ant shape out of the puzzle learning cards 26 respectively having the pieces (M) to be sensed, each of which is made of a forged magnet, and inserted into the grooves 20, replaces the piece (M) made of the forged magnet with a piece (M) made of a genuine magnet, and then puts the puzzle learning card 26 having the replaced piece (M) into a collection box. In order to increase a learning effect, the toy car 34 is mounted on the guide track 32 of the upper plate 10, at which the extension rod 21 of the rotary plate 12 is located.

Thereafter, the guide requires a learner (a child) to find a puzzle learning card 26, related to the word formed on the surface of the assembled unit of the learning assembly blocks 18, and put the puzzle learning card 26 on the base plane 8. When the learner finds a correct puzzle learning card 26 and puts the correct puzzle learning card 26 on the base plane 8, the magnetic lead switch 24 located on the lower surface of the base plane 8 is switched on and the reduction motor 16 is driven. Thus, the rotary plate 12 is rotated. In accordance with the rotation of the rotary plate 12, the toy car 34 on the upper plate 10 runs along the guide track 32 by the magnetic force of the magnetic core 25 connected to the upper end of the extension rod 21 of the rotary plate 12.

When the assembled unit of the learning assembly blocks 18 is close to the puzzle learning card 26 by the rotation of the rotary plate 12, the puzzle learning card 26 is floated by the magnetic force of the magnet piece 19 inserted into the assembled unit of the learning assembly blocks 18, and thus is separated from the base plane 8 and is attached to the lower surface of the rotary plate 12. Thereby, the corresponding magnetic lead switch 24 on the lower surface of the base plane 8 is switched off, and thus the rotation of the rotary plate 12 is stopped and the movement of the toy car 34 is stopped.

The guide allows the learner to play a higher-grade learning game by another method using the puzzle learning cards 26 and the learning assembly blocks 18, when the learner has a higher intellectual level, and allows the learner to play convenient and various learning games with reference to the guide book provided together with the game apparatus for learning. If necessary, it is possible to set a learning game dosing time using the stopwatch 40.

FIG. 23 illustrates another example of learning games using the puzzle learning cards 26, the learning assembly blocks 18, and the metal pieces 19*a*.

A guide inserts the metal piece 19*a* into the lower portion of a learning assembly block 18 including the electric circuit unit 146 installed therein and provided with a head part 46 having a rabbit face shape, and then inserts the learning assembly block 18 into any insertion groove 22 of the upper plate 10 of the housing main body 4. Then, the guide controls the variable speed controller 28 such that the rotary plate 12 is rotated as slowly as possible. Thereafter, the guide puts the puzzle learning card 26 having the piece (M) to be sensed, made of a genuine magnet, on the base plane 8 so that the puzzle learning card 26 serves as a starting key. Thereby, the rotary plate 12 is rotated slowly. Under the above state, the guide requires a learner to assembly the learning assembly blocks 18 such that a word related to the head part 46 having the rabbit face shape, i.e., a word "rabbit", is formed on the surface of the assembled unit of the learning assembly blocks 18, and simultaneously insert the assembled unit of the learning assembly blocks 18 into an insertion groove 20 of the rotary plate 12 such that the assembled unit of the learning assembly blocks 18 is floated toward the upper plate 10. Herein, the guide inserts the magnet piece 19 made of a genuine magnet only into the upper portion of the assembled unit of the learning assembly blocks 18 in advance. When the learner inserts the correctly assembled unit of the learning assembly blocks 18 loosely into any insertion groove 20 of the rotary plate 12, which is rotated, the rotary plate 12 is continuously rotated and thus the assembled unit of the learning assembly blocks 18 is close to the head part 46 having the rabbit face shape, as shown in FIG. 24. Then, the assembled unit of the learning assembly blocks 18 on the rotary plate 12 is floated by the magnetic force, and is attached to the lower surface of the upper plate 10. Thereby, the LED 144 in the electric circuit unit 146 of the learning assembly block 18 provided with the head part 46 having the rabbit face shape is lighted up.

Next, with reference to FIG. 25, one example of learning games using the puzzle learning cards 26, the learning assembly blocks 18, the magnet pieces 19, and the toy car 34, which is driven by itself, will be described.

FIG. 25 illustrates one example of learning games using the puzzle learning cards 26, the learning assembly blocks 18, the magnet pieces 19, and the toy car 34, which is driven by itself.

A guide inserts the assembled unit of the learning assembly blocks 18 provided with the lower portion, into which the magnet piece 19 is inserted, into any insertion groove 20 of the rotary plate 12, and the toy car 34, which is electrically driven by itself, as shown in FIG. 18, is provided. Under the above state, the guide requires a learner to design that the toy car 34 and the assembled unit of the learning assembly blocks 18 on the rotary plate 12 run at the same speed of in parallel.

The learner loads the learning assembly block 18, into which the magnet piece 19 is inserted, on the loading part 23 of the toy car 34 so as to drive the toy car 34. Here, if necessary, the learner adjusts the speed selection switch 128 provided on the lower surface of the toy car 34, thus selecting the speed of the toy car 34. Then, the learner puts the toy car 34 on the guide track 32 of the upper plate 10 so as to cause the toy car 34 to run, and inserts the piece (M) to be sensed, made of a magnet, into the learning puzzle card 26 and puts the learning puzzle card 26 on the base plane 8 so that the puzzle learning card 26 serves as a starting key. Thereafter, the learner controls the rotating speed of the rotary plate 12 using the variable speed controller 28 of the housing main body 4 such that the toy car 34 and the assembled unit of the learning assembly blocks 18 on the rotary plate 12 run at the same speed in parallel.

Such a learning game is a combined learning game. In the case that clock learning using the clock learning tool 36 providing a clock concept is added to the learning game, the learning game has a higher level.

Next, one example of learning games using the puzzle learning cards 26, the learning assembly blocks 18, the magnet pieces 19, and the toy car 34, which is driven by external force, will be described.

FIG. 26 illustrates one example of learning games using the puzzle learning cards 26, the learning assembly blocks 18, the magnet pieces 19, and the toy car 34, which is driven by external force.

Under the condition that the toy car 34, which is driven by external force, as shown in FIG. 19, is provided, a guide requires a learner to cause the toy car 34 to run along the guide track 32 and to stop the running of the toy car 34 using another learning assembly block 18 after the toy car 34 has run several times. Here, the guide may require the learner to cause the toy car 34 to run several times using the clock learning tool 36. For example, the guide sets the clock learning tool 36 to 12 o'clock, and requires the learner to stop the running of the toy car 34 at 3 o'clock.

The learner puts the toy car 34 on the guide track 32 of the upper plate 10 such that the toy car 34 coincides with the extension rod 21 of the rotary plate 12. When the piece (M) to be sensed, made of a magnet, is inserted into the learning puzzle card 26 and puts the learning puzzle card 26 on the base plane 8 under the above state, the puzzle learning card 26 serves as a starting key. Thus, the rotary plate 12 is rotated, and the toy car 34 provided with the magnetic plate 132 fixed to the lower surface thereof is pulled by the magnetic force of the magnetic core 25 connected to the upper end of the extension rod 21 and thus runs along the guide track 32.

Thereafter, when the running frequency of the toy car 34 reaches a frequency to be stopped, the learner inserts the magnet piece 19 into the lower portion of another learning assembly block 18 and inserts the learning assembly block 18 into the insertion groove 20 of the rotary plate 12 at a stop position. Then, when the magnet piece 19 inserted into another learning assembly block 18 is close to the learning puzzle card 26 put on the base plane 8 during the rotation of the rotary plate 12, the learning puzzle card 26 is floated and is attached to the lower surface of the rotary plate 12. Thereby, the rotation of the rotary plate 12 is stopped.

Using the game apparatus 2 for learning of the present invention, learners can play various other learning games, as follows.

1) When a letter or a number is expressed by lighting up LEDs on the monitoring matrix part 30*b*, a learner inputs the puzzle learning card 26 corresponding to the letter or the number with the barcode reader 42. When the inputted puzzle learning card 26 is correct, the main control unit 50 of the housing main body 4 generates a message informing the learner of a correct answer through the speaker SPK1, and causes the toy car 34 to run for congratulation through the rotation of the rotary plate 12.

2) The main control unit 50 gives a question of requiring the input of a letter or a number based on a predetermined program, and a learner inputs a letter or a number with the push buttons on the push switch key matrix part 30*a*. The main control unit 50 lights up LEDs on the monitoring matrix part 30*b* corresponding to the inputted push buttons, and generates a message informing the learner of a correct answer through the speaker SPK1 and causes the toy car 34 to run for congratulation through the rotation of the rotary plate 12, when the inputted coordinate value is correct.

3) The main control unit 50 gives a question for requiring the display of a clock picture displaying time on the monitoring matrix part 30*b* based on a predetermined program, and a learner finds a learning puzzle card 26 provided with the time written thereon and inputs the learning puzzle card 26 with the barcode reader 42. Then, the main control unit 50 generates a message informing the learner of a correct answer through the speaker SPK1 and causes the toy car 34 to run for congratulation through the rotation of the rotary plate 12, when the inputted learning puzzle card 26 is correct.

4) When the main control unit 50 expresses an incomplete letter or number by lighting up LEDs on the monitoring matrix part 30*b* based on a predetermined program, a learner completes the letter or number by pressing the push buttons on the push switch key matrix part 30*a*. Then, the main control unit 50 generates a message informing the learner of a correct answer through the speaker SPK1 and causes the toy car 34 to run for congratulation through the rotation of the rotary plate 12, when the pressed push buttons are correct.

Further, the game apparatus 2 for learning of the present invention provides a learner with a task of designing a departure time of the toy car 34 using the clock learning tool 36 so that the toy car 34 arrives at an arbitrary station on the rotary plate 12 at an arrival time. When the learner smoothly achieves the task, the main control unit 50 generates a congratulation message through the speaker SPK1.

Further, the game apparatus 2 for learning of the present invention allows a learner to learn the rules of multiplication using the push switch key matrix part 30*a*, the monitoring matrix part 30*b*, and the transparent multiplication sheet 82, and the main control unit 50 generates corresponding multiplication values through the speaker SPK1.

Further, the game apparatus 2 for learning of the present invention allows a learner to play a learning game, such as stamp designing, using the learning stamp plate 76, the push switch key matrix part 30*a*, and the monitoring matrix part 30*b*.

Further, the game apparatus 2 for learning of the present invention allows a learner to take exercise or play music using the melody keyboard with hands, feet, or a plastic hammer. The main control unit 50 gives a question for requiring performance of melody based on a predetermined program and confirms a result inputted by the learner through the external interface 58. Then, the main control unit 50 generates a message informing the learner of a correct answer through the speaker SPK1 and rotates the rotary plate 12, when the inputted result is correct.

Industrial Applicability

As apparent from the above description, the game apparatus for leaning of the present invention is applied to games, which allow children to learn creativity, brain training and aerobic exercise using hands and feet, which allow old people to prevent dementia and be rehabilitated.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A game apparatus for learning, in which a rotary plate located between a base plane of a base part and an upper plate of a housing main body is axially connected to a driving body installed in the base part such that the rotary plate is rotatable, a plurality of insertion grooves, into which learning assembly blocks are inserted, are respectively formed in the rotary plate and the upper plate in a circumferential shape, and driving sensing elements connected to the driving body are formed on the base plane.

2. The game apparatus for learning according to claim 1, wherein the upper plate is provided with a board unit including a push switch key matrix part, on which a plurality of push buttons is arranged in a matrix structure, and a monitoring matrix part, on which a plurality of LED dots is arranged in a matrix structure, such that the push buttons of the switch key matrix part and the LED dots of the monitoring matrix part are matched with each other one to one and are electrically connected to each other.

3. The game apparatus for learning according to claim 1, wherein a guide track, along which a toy car runs, is formed on the upper plate.

4. The game apparatus for learning according to claim 1, wherein a clock learning tool, provided with a hour hand and a minute hand, and a plate-type learning tool are selectively attached to and detached from an upper end of a shaft axially connected to the rotary plate.

5. The game apparatus for learning according to claim 1, wherein puzzle learning cards put on the driving sensing elements of the base plane are provided, and a piece to be sensed, including a genuine magnet or a forged magnet, is inserted into each of the puzzle learning cards.

6. The game apparatus for learning according to claim 1, wherein an insertion protrusion is formed on a lower portion of a main body of each of the learning assembly blocks and a magnetic piece provided with an insertion hole is connected to an upper portion of the main body of each of the learning assembly blocks.

7. The game apparatus for learning according to claim 1, wherein an insertion protrusion is formed on a lower portion of a main body of each of the learning assembly blocks, an upper portion of the main body of each of the learning assembly blocks has a head having an article shape, and an electric circuit unit, in which a magnetic lead switch and the LED are connected to a small battery in series, is installed in the main body of each of the learning assembly blocks.

8. The game apparatus for learning according to claim 3, wherein an extension rod is extended from the upper surface of the rotary plate close to the lower surface of the upper plate.

9. The game apparatus for learning according to claim 2, wherein a learning stamp plate for pressing the push buttons on the push switch key matrix part is provided with open holes arranged in a matrix structure formed in a lower surface of a main body thereof, and rubber head screws are respectively connected to the open holes.

10. The game apparatus for learning according to claim 2, wherein a transparent multiplication sheet covering the monitoring matrix part is provided, and numbers representing correct answers of the multiplication tables are arranged in a matrix structure on the transparent multiplication sheet.

11. The game apparatus for learning according to claim 3, wherein any one of shafts of front and rear wheels of the toy car is connected to a driving motor installed in the toy car through gears, the driving motor is connected to a battery installed in the toy car through a magnetic lead switch and a power switch, and the magnetic lead switch is located under a loading part of the toy car.

12. The game apparatus for learning according to claim 3, wherein the toy car is a type of a driven car provided with the lower surface to which a magnetic plate is fixed.

13. The game apparatus for learning according to claim 1, wherein a melody keyboard electrically connected to a connection port of the housing main body through a connector is provided, and includes a plurality of musical scale input plates elastically supported by respective springs installed in the keyboard main body, and magnetic lead switches are respectively installed on the lower surfaces of the musical scale input plates and magnet pieces are installed on the bottom of the keyboard main body so as to correspond to the magnetic lead switches.

14. The game apparatus for learning according to claim 13, wherein an electric circuit unit of the melody keyboard includes a mode selection switch for selecting a melody mode and a musical scale mode, a sound source chip provided with input ports connected to the magnetic lead switches for generating a melody sound and a musical scale sound according to the mode selected through the mode selection switch, and a speaker driving unit and a speaker connected to the output of the sound source chip.

15. The game apparatus for learning according to claim 1, wherein the driving sensing elements are magnetic lead switches.

16. The game apparatus for learning according to claim 5, wherein an identifier is formed on each of the puzzle learning cards, and a reader for reading the identifier is provided on the housing main body.

17. The game apparatus for learning according to claim 1, wherein the driving body includes a reduction motor, and a variable speed controller is connected to the reduction motor.

18. A game apparatus for learning, in which a rotary plate located between a base plane of a base part and an upper plate of a housing main body is axially connected to a reduction motor installed in the base part such that the rotary plate is rotatable, a plurality of insertion grooves, into which learning assembly blocks are inserted, are respectively formed in the rotary plate and the upper plate in a circumferential shape, magnetic lead switches connected to the reduction motor are formed on the base plane, wherein: the upper plate is provided with a board unit including a push switch key matrix part, on which a plurality of push buttons is arranged in a matrix structure, and a monitoring matrix part, on which a plurality of LED dots is arranged in a matrix structure, such that the push buttons of the switch key matrix part and the LED dots of the monitoring matrix part are matched with each other one to one and are electrically connected to each other; and an operation voltage is supplied to the magnetic lead switches and dot switches of the push switch key matrix part of the board unit through a power switch provided at the outside of the housing main body.

19. A game apparatus for learning, in which a rotary plate located between a base plane of a base part and an upper plate of a housing main body is axially connected to a driving body installed in the base part such that the rotary plate is rotatable, a plurality of insertion grooves, into which learning assembly blocks are inserted, are respectively formed in the rotary plate and the upper plate in a circumferential shape, and driving sensing elements connected to the driving body are formed on the base plane, wherein: the upper plate is provided with a board unit including a push switch key matrix part, on which a plurality of push buttons is arranged in a matrix structure, and a monitoring matrix part, on which a plurality of LED dots is arranged in a matrix structure; and the driving sensing elements, the driving body, the push switch key matrix part, and the monitoring matrix part are connected to a controller, which is digitally controllable.

20. The game apparatus for learning according to claim 19, wherein the controller includes a main control unit, a voice synthesis chip, a barcode reader, a key input unit, and a display unit.

21. The game apparatus for learning according to claim 19, wherein the controller further includes a stopwatch and a voice memory.

* * * * *